United States Patent [19]

Crosby

[11] Patent Number: 4,857,020

[45] Date of Patent: Aug. 15, 1989

[54] TAP CONNECTOR

[75] Inventor: Nobel W. Crosby, Trenton, Canada

[73] Assignee: Tridem Manufactured Products Inc., Ajax, Canada

[21] Appl. No.: 151,375

[22] Filed: Feb. 8, 1988

[30] Foreign Application Priority Data

Feb. 10, 1987 [CA] Canada ..... 529425

[51] Int. Cl.[4] ..... H01R 11/01

[52] U.S. Cl. ..... 439/783; 439/803

[58] Field of Search ..... 439/783, 784, 790, 791, 439/794, 796, 797, 801, 803, 805, 807, 815, 863

[56] References Cited

U.S. PATENT DOCUMENTS 4,511,204 4/1985 Glenn ..... 439/807
4,515,669 5/1985 Dimond et al. ..... 439/784
4,723,920 2/1988 Werner ..... 439/783
4,734,062 3/1988 Goto ..... 439/783

*Primary Examiner*—P. Austin Bradley
*Attorney, Agent, or Firm*—Rogers & Scott

[57] ABSTRACT

A tap connector for establishing and maintaining an electrical connection between electrical conductors. The connector has a body whereof the sides define a channel which slidably receives a laterally expandible and contractable wedge assembly. In use, the conductors are rigidly held between the body and the expanded wedge assembly. To produce the required expansion, the wedge assembly comprises at least one driven block and at least one driving block which mate along respective opposed ramp surfaces inclined to the longitudinal axis of the channel. Relative longitudinal movement of the blocks causes the wedge assembly to expand and contract as required.

5 Claims, 2 Drawing Sheets

TAP CONNECTOR

This invention relates to a tap connector for electrically connecting at least two electrical conductors. In particular, although not exclusively, the tap connector will be used to make releasable electrical connections between a primary line conductor and a secondary tap conductor.

A variety of tap connectors exist whereby an electrical connection can be established between electrical conductors. These include the so-called bolted tap connector, the compression tap connector and the mechanical wedge-type connector.

Bolted tap connectors take on a variety of forms but essentially comprise two complementary separable components which form cylindrical clamping surfaces for receiving electrical conductors and which in use are held together by means of bolts so as to compress the conductors therebetween. Such connectors have the disadvantages of being awkward to install, it being necessary to align bolts with apertures provided in the components of the clamp and to tighten the bolts to maintain electrical contact.

In the compression tap connector, two oppositely directed C-shaped channels having inturned flange portions are used to envelope respective line and tap conductors. Electrical contact is maintained by swaging or compressing the flange portions around the conductors with a hydraulic compression tool. Because the connector is deformed in such an operation, it is obviously not reuseable.

The mechanical wedge-type connector includes a tapered C-shaped body which, in use, envelopes the line and tap conductors in the end portions. Electrical contact is maintained by driving a wedge-shaped keeper into the body so that the conductors are wedged between the keeper and the body. The connector is only adapted to accommodate a small range of conductor diameters, as the space for receiving the conductors is subject to very small tolerances. In order to ensure a reliable electrical connection, the keeper must be forcibly driven relative to the body. This is often carried out by means of an explosive impact tool making it impractical to dislodge the keeper from the body in order to reuse the connector. In addition, special attention is required to minimize the hazards associated with storing explosives and extreme care must be exercised during use in order to keep the working environment safe.

An object of this invention is to provide an alternative type of tap connector which overcomes at least some of the above-mentioned disadvantages of the prior art.

In accordance with the invention, there is provided a tap connector comprising a body and a wedge assembly. The body has at least two opposed laterally directed sides which define a channel having a longitudinal axis, and the wedge assembly is adapted for longitudinal sliding along the channel, so as to clamp the conductors between opposed longitudinal sides of the assembly and inwardly directed sides of the body. The wedge assembly includes at least one driven block and at least one driving block, the blocks mating along respective opposed ramp surfaces inclined to the longitudinal axis so that sliding of said at least one driving block in a first longitudinal direction along said longitudinal axis toward said at least one driven block, with said ramp surfaces juxtaposed in operative engagement, causes lateral expansion of the assembly and wedges the conductors. Sliding in a second opposite longitudinal direction, away from the driven block, whereby the ramp surfaces are separated, allows lateral contraction of the assembly so as to thereby unclamp the conductors.

A preferred embodiment of the invention is described below, by way of example only, and with reference to the following drawings, in which.

Figure 2:
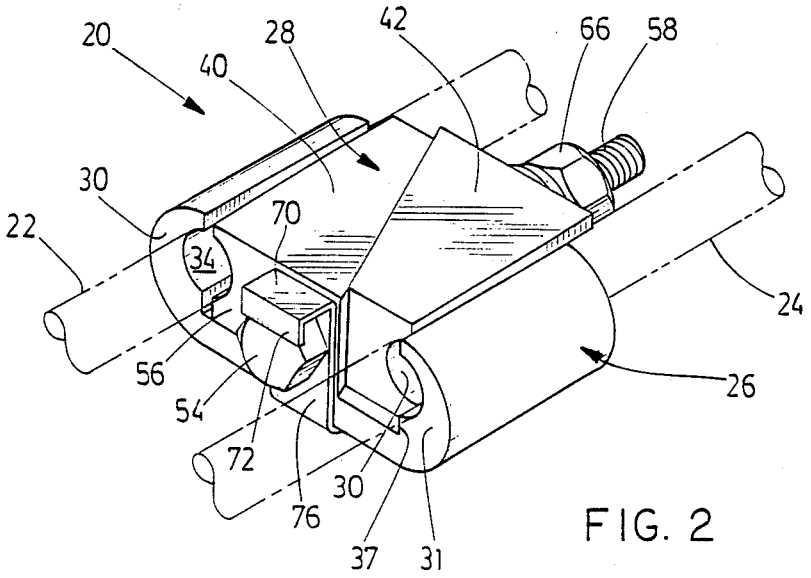
FIG. 2 is a perspective view illustrating the assembled tap connector of FIG. 1.
Figure 3:
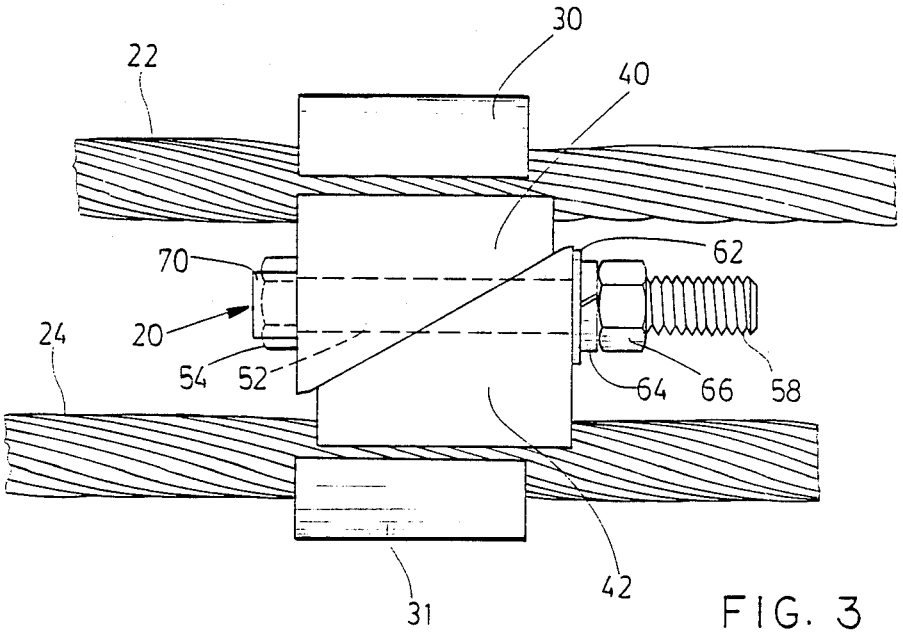
FIG. 3 is a top plan view of the tap connector of FIG. 2, in use, connecting a pair of electrical conductors.

The tap connector according to the invention is generally indicated by numeral 20 in the accompanying drawings, and is preferably made from a wrought aluminum alloy suitable for electrical applications. As seen in FIG. 3, the tap connector 20 is used to establish and maintain an electrical connection between a pair of electrical cable conductors 22, 24. A first conductor 22 may be a primary electrical supply line, for example, and a second conductor 24, may be a secondary tap conductor. The conductors 22, 24 are illustrated in ghost outline in FIGS. 1 and 2.

Figure 1:
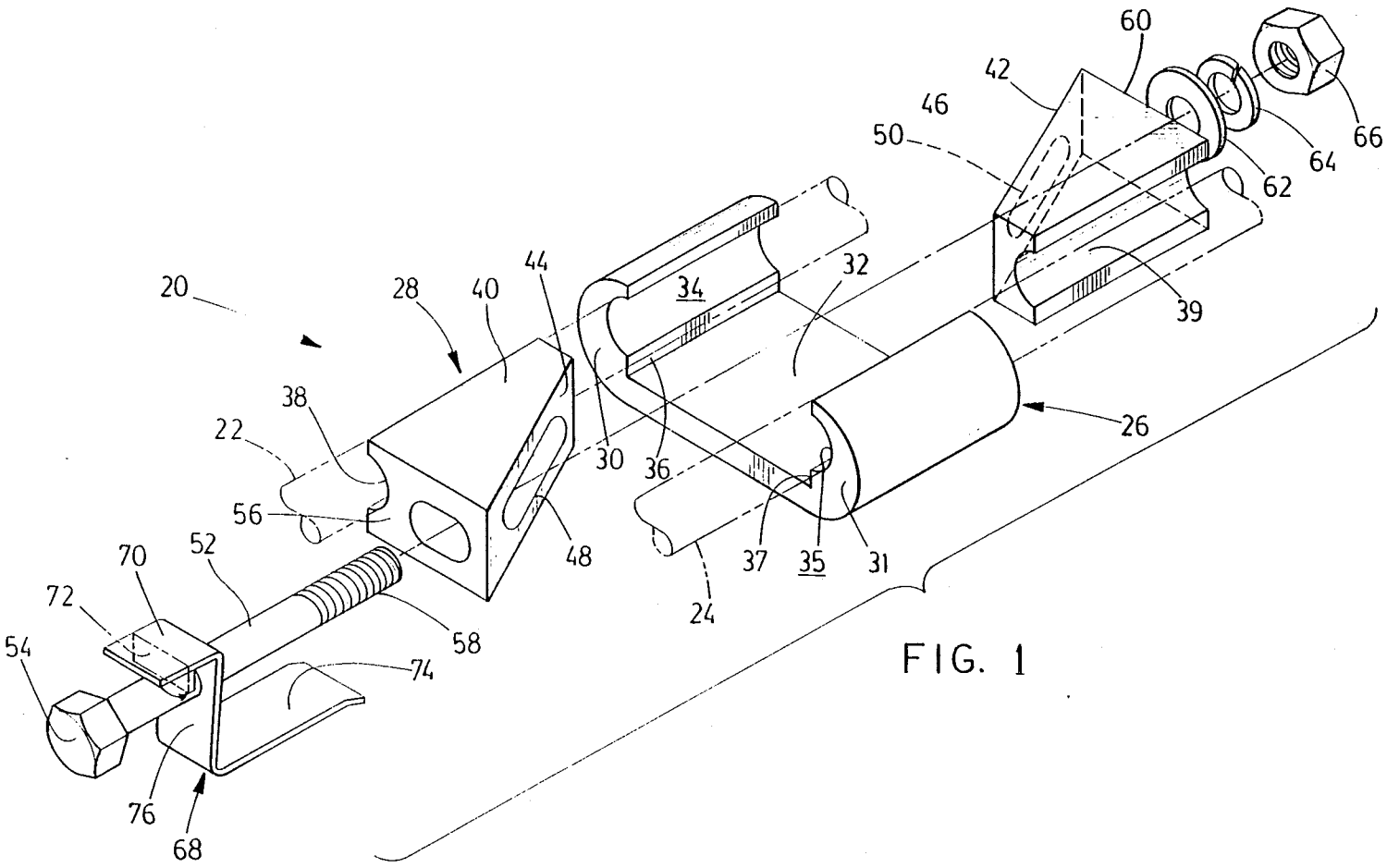
FIG. 1 is an exploded perspective view of a tap connector according to the invention.

Referring more particularly to FIG. 1, the tap connector 20 includes a body 26 having a substantially C-shaped transverse cross-section and a wedge assembly 28 slidably received within the body 26. The wedge assembly 28 includes two congruent blocks 40, 42 of truncated right angle triangular shape as seen in plan, described further below which, in use, co-operate with each other to laterally expand the wedge assembly so as to clamp the conductors 22, 24 against the body 26, or to allow contraction of the wedge assembly so as to unclamp the conductors from the body.

To partly confine the conductors 22, 24, for retention in the connector in use, the body 26 has a pair of opposed transversely directed sides 30, 31 each having respective concave inner faces 34, 35. Together, the sides 30, 31 define a channel 32 having a longitudinal axis. The concave inner surfaces 34, 35 merge internally with guide walls 36, 37 which meet the channel 32 substantially at right angles so as to guide the wedge assembly 28 in operable alignment with the body 26 and so as to provide for longitudinal sliding of the wedge assembly 28 along the channel 32, as is more fully described below.

Opposed lateral sides 38, 39 of the wedge assembly 28 each have a concave face adapted to complement the concave inner faces 34, 35 of the body 26. As can readily be seen in Figure 2, the lateral sides 38, 39 and the respective transversely directed sides 30, 31 together form a pair of substantially cylindrical clamping surfaces adpated to clamp the electrical conductors 22, 24 respectively therebetween.

In its assembled operative configuration, the wedge assembly 28 has a generally rectangular cross-section which fits snugly between the guide walls 36, 37 of the transversely directed sides 30, 31 in sliding engagement with the channel 32. The block 40 is designated as the driven block while the other block 42 is designated as the driving block. In use, the blocks are juxtaposed and mate along respective opposed ramp surfaces 44, 46 inclined to said longitudinal axis. Each block further has a respective longitudinal hole respectively designated by numerals 48 and 50, which lies generally paralle to the longitudinal axis, and which is adapted to receive a bolt 52 for locating the blocks 40, 42 of the wedge assembly 28 in an operative orientation relative to each other. The apertures 48, 50 traverse the wedge assembly through the ramp surfaces 44, 46 and have a diameter considerably greater than that of the bolt 52, so as to accomodate relative lateral movement of the blocks 40, 42 through full range of lateral positions permitted by the guide walls 36, 37.

The bolt 52 is sufficiently long to more than traverse the wedge assembly 28 through the apertures 48, 50 and has a head 54 which lies in abutment with a retaining clip 68 positioned between the head 54 and a transverse end 56 of the driven block 40. A threaded shank 58 on the bolt 52 protrudes from the opposed transverse end 60 of the driving block 42 and is received in a washer 62, lock washer 64 and nut 66.

The retaining clip 68 is formed from strip metal and has a generally vertical portion 76 which is apertured to receive the bolt 52 and which spans the height of the assembled tap connector. At the operatively upper end of the clip 68, the vertical portion 56 is bent outwardly through a ninety degree angle, and then bent through a second spaced ninety degree angle (i.e. a total of 180 degrees) to define a first flange 70 with a downward lip 72 spaced from the vertical portion 76, so as to accomodate the head 54 therebetween. At the operatively lower end of the clip 68, the vertical portion 76 is bent inwardly (90 degrees) to define a second flange 74 extending longitudinally under the body 26.

The clip 68 connects the bolt 52 to the body 26 so that the component parts of the tap connector are attached to each other and form a single unit. In addition, the vertical portion 76 of the clip 68 may be brought into abutment with a lateral edge of the body 26 and the driven block 40 positioned in abutment with the vertical portion 76 of the clip 68, thereby centering the wedge assembly 28 relative to the body and maximizing the effective clamped length of the conductors. The clip 68 thus holds the wedge assembly 28 in an operable orientation relative to the channel 32.

In use, the ramp surfaces 44, 46 of the driven block and driving block are juxtaposed so that at least a portion of each aperture 48, 50 registers with a portion of the other aperture thereby allowing insertion of the bolt 52. Moreover, the bolt 52 is made sufficiently long to separate the ramp surfaces 44, 46 for contraction of the wedge assembly into an orientation which allows insertion of the conductors in the body 26 without removal of the nut 66. With the retaining clip 68 positioned on the shank 58, the bolt 52 is firstly fitted through the aperture 48 of the driven block 40 and secondly through the aperture 50 of the driving block 42. The second flange 74 of the retaining clip 68 may then be slid under the body 26, and the washer 62, lock washer 64 and nut 66 operably positioned on the bolt shank so that the driven block 40 and driving block 42 lie between the head 54 and the nut 66. The conductors may then be placed between respective concave inner surfaces 34, 35 of the body 26, and the lateral sides 38, 39 of the wedge assembly 28.

The nut 66 is then tightened so that it moves longitudinally along the axis of the shank 58 toward the head 54, thus urging the driving block 42 in a first longitudinal direction which brings its ramp surfaces 46 in a position which is juxtaposed to the ramp surface 44 of the driven block 40. As the ramp surfaces slide over each other the lateral force component created by the longitudinal movement causes the wedge assembly 28 to expand laterally, thus clamping the conductors 22, 24 one each between the opposed lateral sides 38, 39 of the assembly and the transversely directed sides 30, 31 of the body 26 In this manner, the tap connector is able to effeciently establish and maintain an electrical connectionn between the connector.

In order to release the conductors, the nut 66 is merely slackened so as to allow the driving block 42 to be slid in a second longitudinal direction. Such sliding movement of the driving block 42 may be brought about, for example, by tapping it in the appropriate direction with a suitable impact device. The ramp surface 44, 46 are then separated and the wedge assembly 28 is allowed to contract laterally.

It will be appreciated that the tap connector according to the invention has numerous advantages. It can be easily installed using conventional tools and may be used to accomodate a range of sizes of electrical conductors by varying the effective width of the wedge assembly. The hazards of using explosives are overcome and yet a secure and adjustable clamping load is provided with minimal damage to electrical conductors. This promotes good electrical performance. Conveniently, the component parts of the tap connector are made from wrought aluminum alloy. They are thus economical to manufacture and further benefit from enhanced electrical performance.

Advantageously, the tap connector is also reusable. Obviously, this reduces the cost of using tap connectors and has a concomitant advantage of encouraging the use of tap connectors where they would otherwise not be used and where the safety of electrical line workers might be unnecessarily compromised. Moreover, the inconvenience of having to work with ever shorter cables as a result of cutting off 'disposable' tap connectors is eliminated.

It will be understood that several variations may be made to the above-described embodiment of the invention without departing from the claimed scope thereof. For example, the wedge assembly could have three weding blocks, including a central driving block and a pair of opposed driven blocks mating with the driving block along ramped surfaces such that the wedge assembly may be expanded or contracted as required in the general same manner as described above. It will also be understood that the urging means for bringing about the required sliding of the driving block relative to a driven block may vary considerably and could even, for example, include a simple impact device such as a mallet. Furthermore, the shape and configuration of the body for receiving the wedge assembly may vary as required, as will the radius of curvature of the concave sides for receiving the electrical conductors, particularly where it is desirable to make a set of tap connectors adapted for use with a wide size range of electrical conductors.

I claim:

1. A tap connector for electrically connecting at least two electrical conductors comprising:

a body having at least two opposed transversely directed sides defining a channel having a longitudinal axis;

a wedge assembly for wedging the conductors between opposed lateral sides of the assembly and said transversely directed sides of the body, the wedge assembly being adapted for longitudinal sliding along the channel, and including at least one driven block and at least one driving block, said blocks mating along respective opposed ramp surfaces inclined to said longitudinal axis so that sliding of said at least one driving block in a first longitudinal direction along said longitudinal axis towards said at least one driven block, with said ramp surfaces in juxtaposed operative engagement, causes lateral expansion of the assembly thereby to clamp said conductors as aforesaid, and sliding of said at least one driving block in a second opposite longitudinal direction away from said at least one driven block allows lateral contraction of the assembly thereby to unclamp said conductors.

2. A tap connector according to claim 1 including locating means to locate the blocks of the wedge assembly in an operative orientation relative to each other.

3. A tap connector according to claim 2 in which the locating means include a bolt dimensioned to traverse the wedge assembly in a substantially longitudinal direction through said opposed ramp surfaces, and a nut cooperating with the bolt, said nut and bolt being positioned, such that tightening of the nut on the bolt urges said at least one driving block to slide in said first longitudinal direction and slackening of the nut allows said at least one driving block to be slid in said second longitudinal direction.

4. A tap connector for electrically connecting a pair of electrical conductors comprising:

a body of substantially C-shaped cross-section having a pair of parallel opposed transversely directed sides defining a channel having a longitudinal axis and adapted to partly confine respective conductors in use;

a wedge assembly for clamping the conductors, one each, between opposed lateral sides of the assembly and said transversely directed sides of the body, the wedge assembly including two congruent blocks, said blocks including a driven block and a driving block mating along respective opposed ramp surfaces inclined to said longitudinal axis so that sliding of the driving block along the channel in a first longitudinal direction towards the driven block with said ramp surfaces in juxtaposed operative engagement causes lateral expansion of the assembly thereby to clamp said conductors as aforesaid, and sliding of the driving block in a second opposite longitudinal direction allows lateral contraction of the assembly thereby to unclamp said conductors, each of said two blocks having an aperture therethrough which in use lies generally parallel to said longitudinal axis and which is of sufficient lateral dimension to allow at least a portion of each aperture to register with a portion of the other aperture in a range of relative positions of the driven block and driving block allowing for clamping and unclamping of the conductors; and locating means including a bolt and a nut, the bolt being dimensioned to, in use, traverse the wedge assembly through said apertures, so as to lie with a head in abutment with a transverse end of the driven block and a threaded shank protruding from an opposed transverse end of the driving block for support of the nut such that tightening of the nut on the shank towards the head causes the driving block to slide in said first longitudinal direction and slackening of the nut allows the driving block to be slid in said second longitudinal direction.

5. A tap connector for electrically connecting a pair of electrical conductors comprising:

a body of substantially C-shaped cross-section having a pair of parallel opposed transversely directed sides defining a channel having a longitudinal axis and adapted to partly confine respective conductors in use;

a wedge assembly for clamping the conductors, one each, between opposed lateral sides of the assembly and said transversely directed sides of the body, the wedge assembly including two congruent blocks, said blocks including a driven block and a driving block mating along respective opposed ramp surfaces inclined to said longitudinal axis so that sliding of the driving block along the channel in a first longitudinal direction towards the driven block with said ramp surfaces in juxtaposed operative engagement causes lateral expansion of the assembly thereby to clamp said conductors as aforesaid, and sliding of the driving block in a second opposite longitudinal direction allows lateral contraction of the assembly thereby to unclamp said conductors, each of said two blocks having an aperture therethrough which in use lies generally parallel to said longitudinal axis and which is of sufficient laterial dimension to allow at least a portion of each aperture to register with a portion of the other aperture in a range of relative positions of the driven block and driving block allowing for clamping and unclamping of the conductors;

locating means including a bolt and a nut, the bolt being dimensioned to, in use, traverse the wedge assembly through said apertures, so as to lie with a head in abutment with a transverse end of the driven block and a threaded shank protruding from an opposed transverse end of the driving block for support of the nut such that tightening of the nut on the shank towards the head causes the driving block to slide in said first longitudinal direction and slackening of the nut allows the driving block to be slid in said second longitudinal direction; and a retaining clip for engaging the bolt and the body so as to hold the wedge assembly in an operative orientation relative to the channel.

* * * * *